US005896152A

United States Patent [19]

Ohashi

[11] Patent Number: 5,896,152

[45] Date of Patent: Apr. 20, 1999

[54] INK JET HEAD, CARTRIDGE AND INK TANK THEREFOR

[75] Inventor: Tetsuyo Ohashi, Yokohama, Japan

[73] Assignee: Canon Kabushiki Kaisha, Tokyo, Japan

[21] Appl. No.: 08/590,512

[22] Filed: Jan. 24, 1996

Related U.S. Application Data

[62] Division of application No. 08/174,459, Dec. 28, 1993, Pat. No. 5,512,925.

[30] Foreign Application Priority Data

Dec. 28, 1992 [JP] Japan ..... 4-348492

[51] Int. Cl.[6] ..... B41J 00/00

[52] U.S. Cl. ..... 347/86; 347/49

[58] Field of Search ..... 347/86, 49, 85, 347/87, 47, 44

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,896,171 | 1/1990 | Ito | 347/86 |
| 5,155,502 | 10/1992 | Kimura et al. | 347/87 |
| 5,162,817 | 11/1992 | Tajika et al. | 347/86 |
| 5,216,448 | 6/1993 | Unosawa et al. | 347/49 |

FOREIGN PATENT DOCUMENTS

| | | | |
|---|---|---|---|
| 381392 | 8/1990 | European Pat. Off. | 347/86 |
| 0496642 | 7/1992 | European Pat. Off. . | |
| 0529625 | 3/1993 | European Pat. Off. . | |
| 3401071 | 7/1985 | Germany . | |
| 63-3959 | 1/1988 | Japan | B41J 3/04 |
| 63-4953 | 1/1988 | Japan | B41J 3/04 |

*Primary Examiner*—Joseph Hartary

*Attorney, Agent, or Firm*—Fitzpatrick, Cella, Harper & Scinto

[57] ABSTRACT

An ink container detachably connectable with an ink inlet of an ink jet head for ejecting ink includes an ink supply port for supplying the ink to the ink jet head; a connecting portion for connection with the ink jet head; wherein the connecting portion is directed in a plurality of directions to permit connection with the ink jet head in a plurality of directions.

3 Claims, 11 Drawing Sheets

INK JET HEAD, CARTRIDGE AND INK TANK THEREFOR

This application is a division of application Ser. No. 08/174,459 filed Dec. 28, 1993 now U.S. Pat. No. 5,512,925.

FIELD OF THE INVENTION AND RELATED ART

The present invention relates to an ink jet recording apparatus for ejecting ink to effect recording, and to a recording head for ejecting the ink and method for mounting to the recording head an ink container for containing ink. Recently, printers, facsimile machines, word processors or other information recording machines have been widely developed. Among the recording machines, the ink jet type recording machines are widely used because of the advantage thereof in the high resolution, high speed recording, low cost and small size or the like. The recent demands for these machines, are directed more to the small size and the low running cost. As for the size reduction, an ink jet apparatus shown in FIG. 11, for example, has been proposed in which a recording head 1801*a* and an ink container 1801*b* containing ink absorbing material filled with the ink, are integrally constituted into a recording head cartridge 1801. The head cartridge 1801 is detachably mountable to a mounting portion 1802 of the recording apparatus. As for the reduction of the running cost, there has been proposed that a recording head 1901 and an ink container 1903 are separately constituted, and they are detachably and separately mounted on the mounting portion 1903 of the recording apparatus.

In another example shown in FIG. 13, the recording head 2001 is connected and fixed to the mounting portion 2002 of the recording apparatus, and the ink container 2003 is replaceably connected to the recording head 2001.

In consideration of such various types of ink jet recording machines, the inventors have found the following problems with the mounting of the recording head and the ink container to the ink jet recording apparatus.

In the method of FIG. 11, if the ink ejecting direction is determined, the direction of mounting the head cartridge 1801 on the mounting portion 1802 of the recording apparatus is definitely determined, and therefore, the ink supply direction to the ink jet head is also definitely determined. If an attempt is made to use the head cartridge to another apparatus, or when the direction of installation of the apparatus is going to be changed, it suffers from limitation regarding the ink supply performance. Thus, the latitude and utility is not enough.

In the method of FIG. 12, the ink supply to the recording head from the ink container is effected through an ink supply passage 1904, and therefore, the direction of the ink container can be selected to be most proper to the ink supply irrespective of the direction of the ink ejection (direction of the recording head). However, the necessity for the provision of the ink supply passage 1904 increases the cost and size.

The method of FIG. 13 involves the problem that the recording head is not easily replaced upon it becomes out of order, because the recording head is fixed to the carriage.

SUMMARY OF THE INVENTION

Accordingly, it is a principal object of the present invention to provide an ink container, ink jet head cartridge, ink jet head and ink container mounting method by which the ink can be stably supplied to the recording head even when it is mounted to another type of apparatus or when the position of the apparatus is changed.

According to an aspect of the present invention, there is provided an ink container detachably connectable with an ink inlet of an ink jet head for ejecting ink, comprising: an ink supply port for supplying the ink to the ink jet head; a connecting portion for connection with the ink jet head; wherein the connecting portion is directed in a plurality of directions to permit connection with the ink jet head in a plurality of directions.

According to another aspect of the present invention, there is provided an ink jet head cartridge as defined above, comprising and an ink jet head including an ejection outlet for ejecting the ink, an ink passage in communication with the ink ejection outlet, an ink ejection pressure generating element provided corresponding to the ink liquid passage, an ink inlet for receiving ink supply from the ink container through the ink supply port and a connecting portion for connection with the connecting portion of the ink container.

According to a further aspect of the present invention, there is provided an ink jet recording apparatus having an ink jet cartridge as defined above and a carriage for detachably mounting the ink jet cartridge.

According to the present invention, the recording head can be mounted irrespectively of the mounting direction of the ink container, and therefore, the direction of the ink ejection can be changed as desired.

After the ink is used up, only the ink container is exchanged, and therefore, the running cost can be reduced.

After the service life of the recording head, or upon the malfunction of the recording head, the recording head can be easily exchanged.

The ink jet cartridge may be commonly used for various types of main assembly of the apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Embodiment 1

Figure 1:
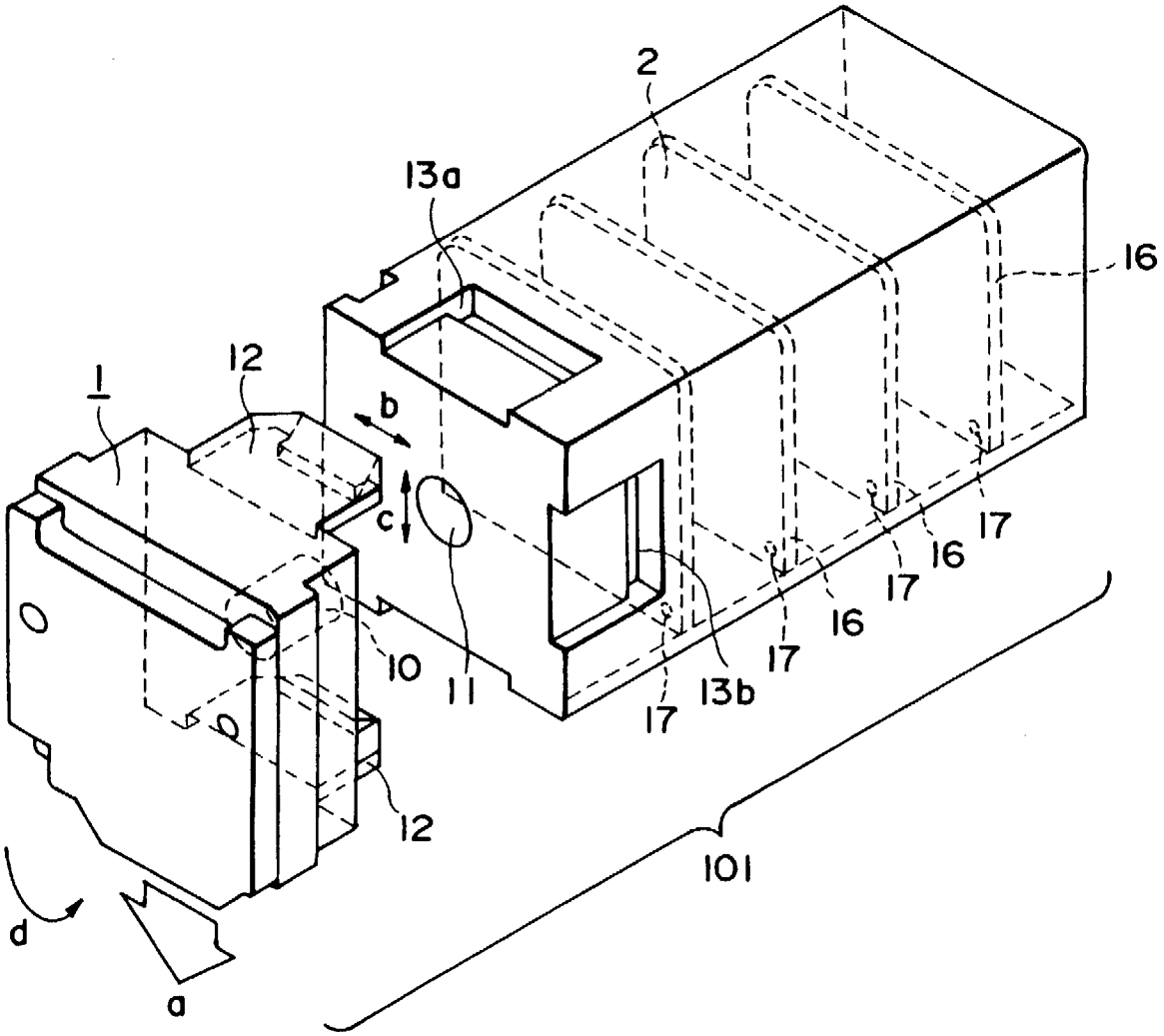
FIG. 1 is a schematic perspective view of a recording head cartridge according to a first embodiment of the present invention.

Referring to FIG. 1, there is shown a recording head and an ink container of a recording apparatus according to an embodiment of the present invention. In this Figure, designated by a reference numeral 1 is a recording head for ejecting ink in response to an electric signal; 2 is an ink container for containing ink to be supplied to the recording head 1; 10 is an ink inlet part of the recording head for receiving ink from the ink container 2; 11 is an ink supply port for supplying ink to the recording head from the ink container 2; 12 are connecting portions in the form of connecting claws of a recording head for guiding and fixing the recording head and the ink container with each other; 13*a* and 13*b* are guiding grooves for the connecting claws engageable therewith; 16 are internal partition walls for dividing the inside into small chambers; 17 ate communication holes formed in the internal partition walls 16. By these parts, the head cartridge 101 is constituted. The recording head 1 is constituted by combining a substrate and a top plate. The substrate is provided with a plurality of electrothermal transducer element for producing thermal energy to be used for ink ejection and driving circuits for driving them. The top plate 6 is provided with ejection outlets and liquid passages corresponding to the electrothermal transducer element and a recess for constituting a common liquid chamber in communication with the liquid passages. Such a side of the recording head as is provided with ejection outlets is faced to a recording medium in operation. In FIG. 1, the ink is ejected in the direction a.

The ink container contains the ink to be supplied to the recording head 1 in accordance with consumption with the ink used for the recording. Before it is mounted to the recording head, it is sealed by unshown sealing means to prevent leakage of the ink through the ink supply port 11. The sealing means is automatically or manually removed upon mounting to the recording head 1 to permit ink supply. In addition, a mechanism may be provided to introduce the ambient air in accordance with the ink volume consumed. Furthermore, by maintaining the ink pressure to be supplied to the recording head under small vacuum condition, the print quality can be increased with the ink leakage preventing mechanism being built inside.

The recording head and the ink container 2 are used during the recording operation while they are integral with each other (head cartridge 101). The description will be made as to the connection therebetween.

As shown in FIG. 1, the recording head 1 and the ink container 2, are fundamentally made integral by connecting the ink inlet part 10 of the recording head and the ink supply port of the ink container, and therefore, the connecting portion is so constituted that the ink leakage and the introduction of the air into the ink passage is prevented. In this embodiment, the elasticity of the molded member is utilized for this purpose. More particularly, the ink inlet portion 10 of the recording head and the ink supply port 11 of the ink container are formed into a cylindrical form by a molding material. The inside diameter of the ink supply port 11 of the ink container is slightly smaller than an outer diameter of the ink supply port 10 of the recording head (FIG. 8(*a*)). When the ink supply port of the recording head is press-fitted into the ink supply port 11 of the ink container, they are closely contacted and made integral with slight deformation in the radial direction. The connecting portion is not limited to the molding member, but it will suffice if it has sealing function, and therefore another type of connection is usable. In the unification of the recording head and the ink container 2, the connection between the ink inlet portion of the recording head and the ink supply port 11 of the ink container, will be satisfactory. However, in order to prevent the disconnection upon unexpected external force in the manipulation of the head cartridge 101, and in order to easy unification manipulation, a connecting claw 12 and a guiding groove 13*a* therefor are used in this embodiment to provide more stabilized connection. The connecting claw 12*a* is integrally molded together with the ink supply portion 10 of the recording head and the connecting claw 12 which is elastically deformable, and is provided with a projection at an end. The elastic deformation occurs by the height of the projection when the engagement is established between the claw 12 and guiding groove 13*a*. A deeper groove portion at a rear end of the guiding groove 13*a* is engaged with the projection of the connecting claw 12, so that the firm connection is established.

The connecting claw 12, upon the correction between the recording head and the ink container 2, functions as a guide for easy connection between the ink inlet portion 10 of the recording head and the ink supply port 11 of the ink container. More particularly, the length of the connecting claw 12 is larger than the ink inlet portion 10 of the recording head. Before the ink inlet portion 10 of the recording head is brought into contact with the ink supply port 11 of the ink container, the connecting claw 12 is contacted to the ink container 2. An end of the connecting claw 12 is cut inclinedly, and the cut portion functions as a guide in a direction b in FIG. 1 for easy engagement. The projection at the end of the connecting claw 12 is cut inclinedly to function as a guide in the direction c in FIG. 1, for easy engagement.

In this embodiment, the connecting claw is provided on the recording head. However, it may be provided on the ink container 2, or each of them.

The inside of the ink container 2 is divided into small chambers by partition walls 16. The small chambers are in communication with each other through communication holes 17 formed adjacent a bottom surface of the ink container 16 in the ink partition walls 16. In this case, some of the communication holes 17 is required to be filled with the ink, and it is desirable that the side near the communication holes 17 is at a lower level, from the standpoint of the stabilized ink supply, that is, in the position shown in FIG. 1.

If an ink jet apparatus using such an ink container as has the directivity, is installed horizontally or vertically in use, the above-described desirable condition of the ink container is not always satisfied with the result that the ink supply performance is deteriorated.

In consideration of the above, the ink container of this embodiment has a second connecting direction which is approx. 90 degrees away from the above-described first connecting direction by the connecting claw 12 and the guide 13*a*. In the case of the second connecting direction, the connecting claw 12 is similarly used, but another guiding groove 13*b* is used. The engaging manner is the same as in the first connecting direction.

By doing so, even when the recording apparatus is installed vertically or horizontally, or even when the same ink jet cartridge is used for an apparatus having different ink ejecting directions, the direction of the ink container can be properly selected in the direction for permitting stabilized ink supply, irrespective of the position of the recording head.

Therefore, the proper and stabilized ink supply can be assured irrespective of the ink ejecting direction (head position), and therefore, the satisfactory recording operation is assured. According to this embodiment, the rotational symmetrical positions are satisfied between the connecting claw 12 plus guiding groove 13*a* and the connecting claw 12 plus groove 13*b*, with respect to an ink inlet portion 10, and therefore, four mounting positions in total is possible 90 degrees and 180 degrees from the second connecting position. Thus, the latitude for use is larger.

According to this embodiment, it is not necessary to prepare different types of ink containers and ink head cartridges for respective types of the recording apparatuses and the respective using positions of such recording apparatuses, and therefore, the cost reduction is expected. Additionally, there is no need of adding special structure in the apparatus.

The ink container of this embodiment may contain an ink absorbing material therein.

In this embodiment, the ink jet head is provided with a pair of connecting claws 12, but the ink jet head may be provided with two pairs of connecting claws with the similar connecting mechanism. Alternatively, the ink jet head may be provided with two pairs of guiding grooves, with a pair of connecting claws provided on the ink container.

The description will be made as to a carriage for detachably mounting the ink jet head cartridge.

Figure 2:
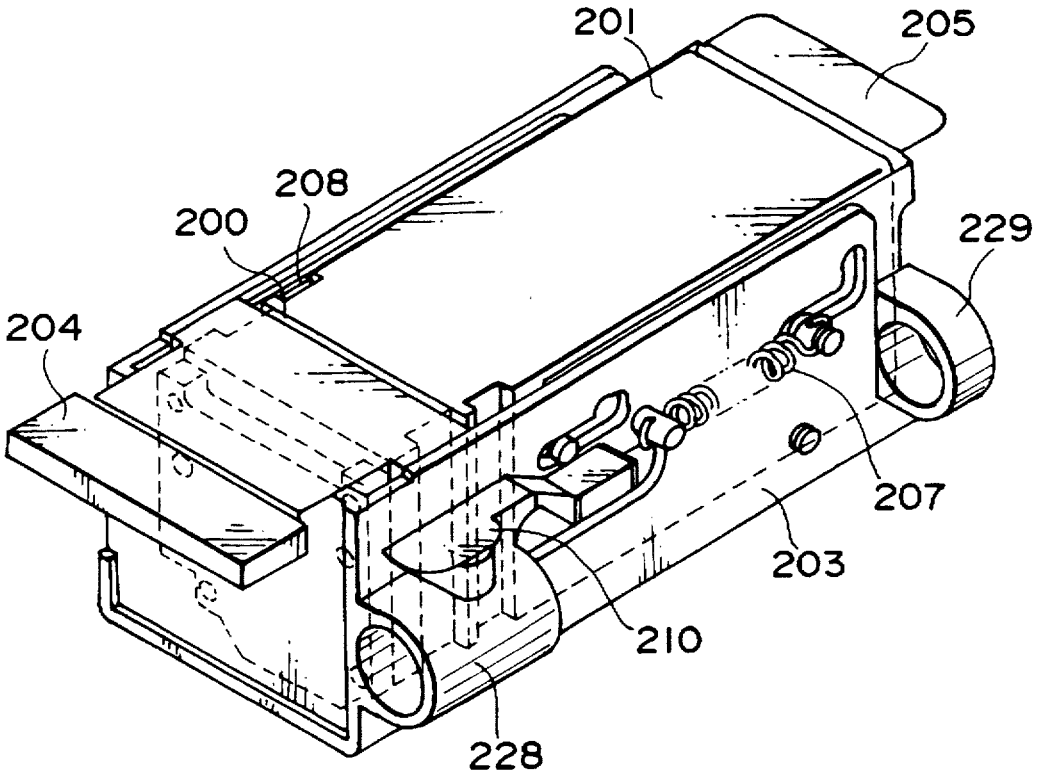
FIG. 2 is a schematic perspective view of a recording head cartridge according to the first embodiment of the present invention, which is mounted on a carriage.

FIG. 2 is a perspective view of the head cartridge and the cartridge of the recording apparatus according to this embodiment of the present invention. In this Figure, reference numeral 200 designates a recording head for ejecting the ink in accordance with an electric signal; 201 is an ink container for containing the ink to be supplied to the recording head; 203 is a cartridge in the main assembly of the apparatus effective to carry the recording head 12 and the ink container 201; 204 is a head lever for supporting and releasing the recording head; 205 is an ink container lever for detachably mounting the ink container 201; 207 is a head holder spring for fixing the recording head 200 to the cartridge 203; 208 is a container case for supporting the ink container 201. By these elements, the head cartridge and the cartridge are constituted.

The description will be made as to the method for mechanically and electrically connecting the recording head on a carriage 102.

Figure 3:
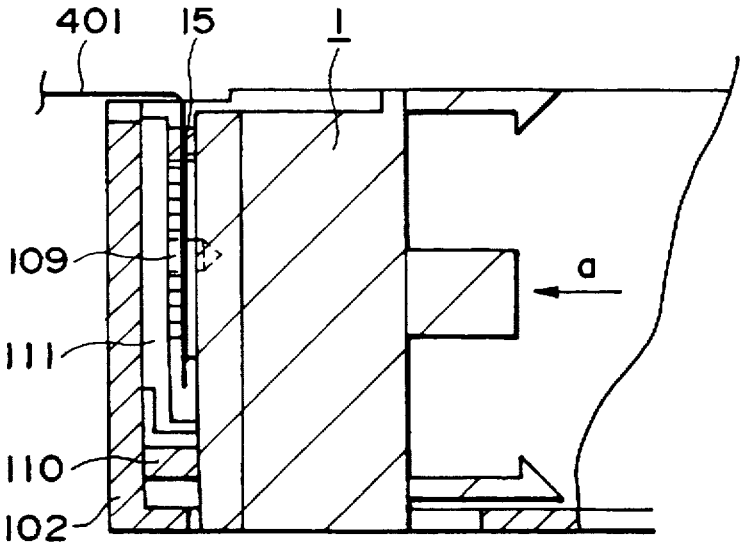
FIG. 3 is an enlarged sectional view of a part of the cartridge according to the first embodiment.

FIG. 3 is a sectional view of the connecting portion between the carriage 102 and the recording head 1 as seen in a direction a in FIG. 1. In the Figure, reference numeral 109 is a positioning pin for engagement with a hole formed in the recording head 1 fixed on the carriage 102 to position it in the vertical direction and a direction perpendicular to the sheet of the drawing; 110 is a stopper fixed to the carriage 102 to receive the recording head 1 urged in a direction a in FIG. 3; 401 is a flexible cable for electrically connecting the main assembly of the recording apparatus and the recording head 1; 111 is a pad interposed between the flexible cable 401 and the carriage 102 to elastically support the flexible cable 401; 15 is a contact portion on the recording head 1 and is electrically connected with the heaters in the recording head 1.

The recording head 11 is urged in a direction a through an unshown lever from the head fixing spring 108. The position thereof is definitely determined by the engagement between the hole of the recording head 1 and the positioning pin 109 and by the interference with the stopper 110. In this manner, the recording head 1 and the carriage 102 are mechanically connected.

On the end surface of the head contact portion 15 of the recording head 1 and the flexible cable 401, there are provided corresponding plural electric contacts. They are pressed to each other with a predetermined pressure. So that the main assembly of the recording apparatus and the recording head 1 are electrically connected. It is necessary that the respective contacts are pressed at once or simultaneously. For the purpose of uniform pressing, there is provided a flexible cable pad 111 of elastic material. The material of the flexible cable pad 111 is of silicone rubber. It comprises plural projections at positions corresponding to the electric contacts to concentrate the pressure on the contact points. The electric contacts of the flexible cable 401 may be in the form of projections in order to further assure the pressure concentrated on the contact points.

In this embodiment, the electric or mechanical connecting portions are on the recording head, but they may be on the ink container, or may be on both of the recording head 1 and the ink container. Alternatively, one may be provided with electric connection mechanism and the other may have mechanical connection mechanism.

The description will be made as to the recording apparatus having the recording head 1, the ink container 2 and the carriage 102 described above.

Figure 4:
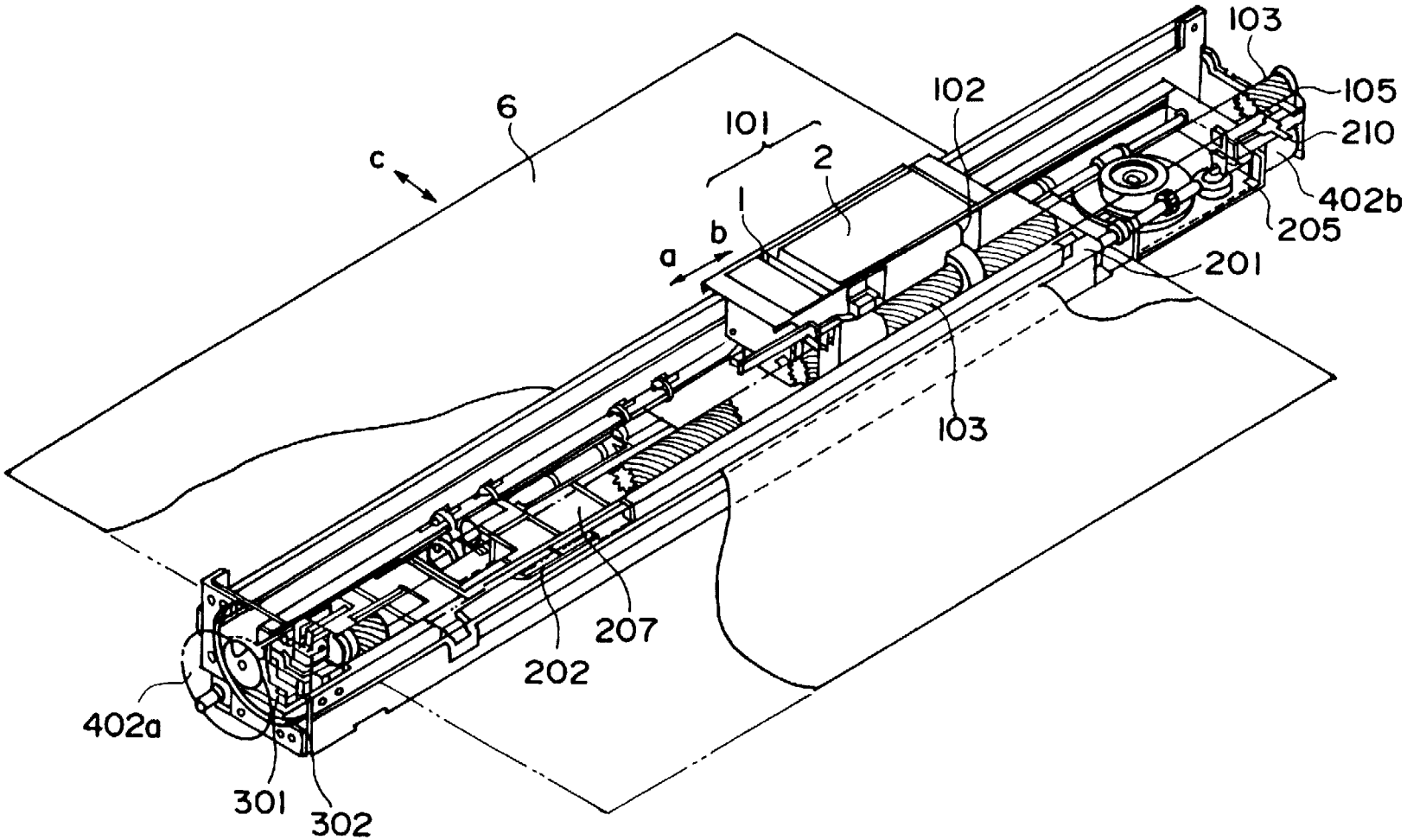
FIG. 4 is a schematic perspective view of the entirety of the recording apparatus of the ink Jet recording type according to the first embodiment of the present invention.

Referring to FIG. 4, there is shown a perspective view of the recording apparatus. The carriage 102 for mounting the head cartridge 101 is provided with a pin (not shown) for engagement with a helical groove 105 of a lead screw 103 which rotates through unshown transmission mechanism in accordance with forward and backward rotation of a carriage motor 402*a*. Thus, it is reciprocated in directions a and b with rotation of the lead screw 103. A recovery unit 301 is provided with a cap 302 faced to an ejection side surface of a head cartridge 101 at a predetermined position (home position, for example) outside the recording region of the head cartridge 101, and a cap driver (not shown) for contacting the cap to the ejection side surface to protect the ejection side surface when the recording operation is not carried out. When the cap is contacted to the ejection side surface, the ink is sucked out through the ejection outlet, by which the ink having increased viscosity, foreign matter bubbles or the like are ejected out to maintain the ink ejection state in order, by the use of a pump and a container for containing the residual ink sucked out.

A sheet feeding means of the recording apparatus will be described. Designated by a reference numeral 201 is a feeding roller for feeding the recording material 6 in a direction c; 202 is a pinch roller for urging the recording material 6 to the feeding roller 201. The recording material 6 is intermittently fed in the direction c during recording operation, while being nipped between these rollers constituting a pair.

Designated by a reference numeral 207 is a platen for providing flat recording surface. The description will be made as to the structure and the electric circuit relating to the information processing apparatus having the recording apparatus of this embodiment.

Figure 5:
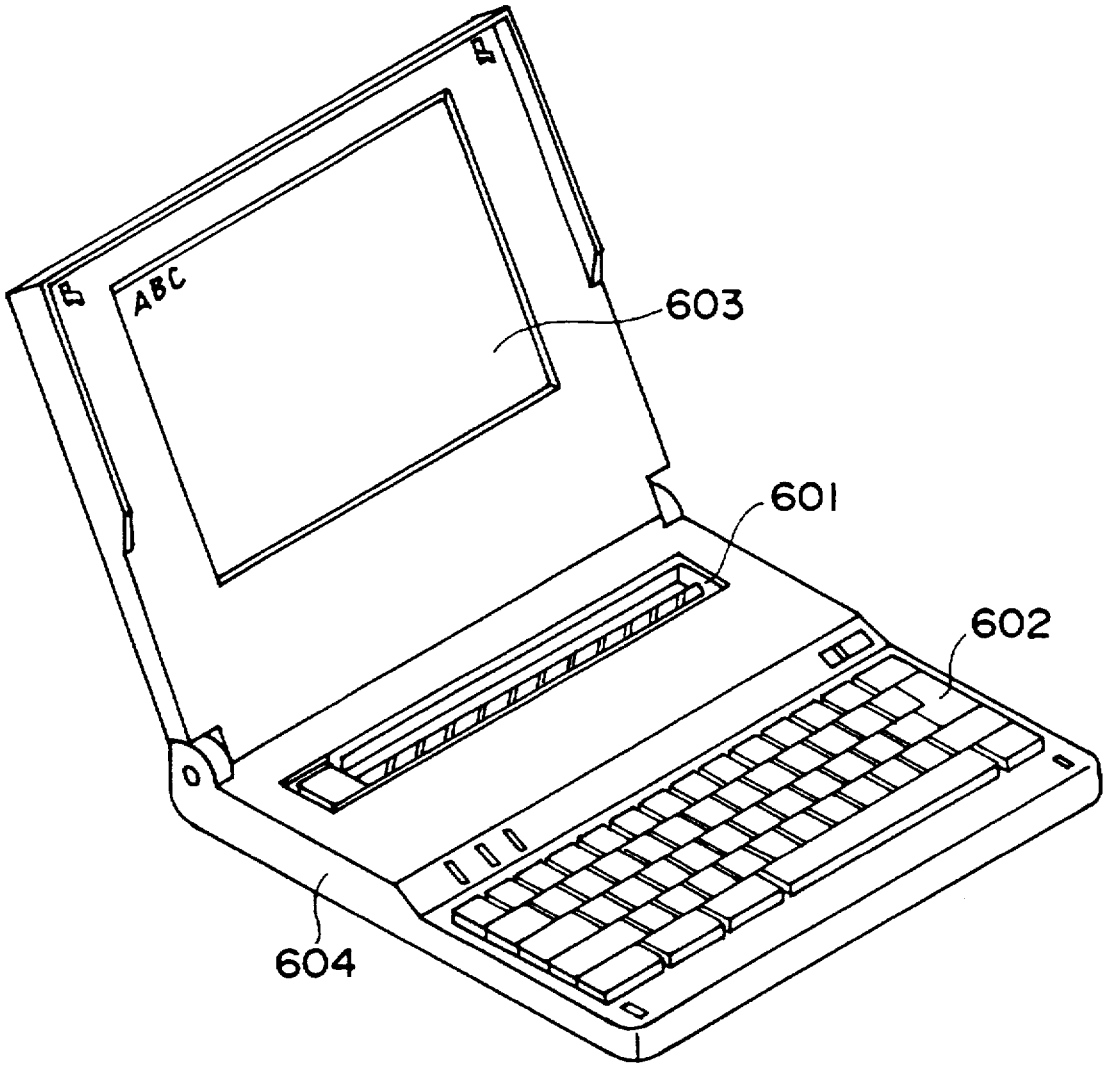
FIG. 5 is a schematic perspective view of information processing apparatus using the ink jet recording apparatus.
Figure 6:
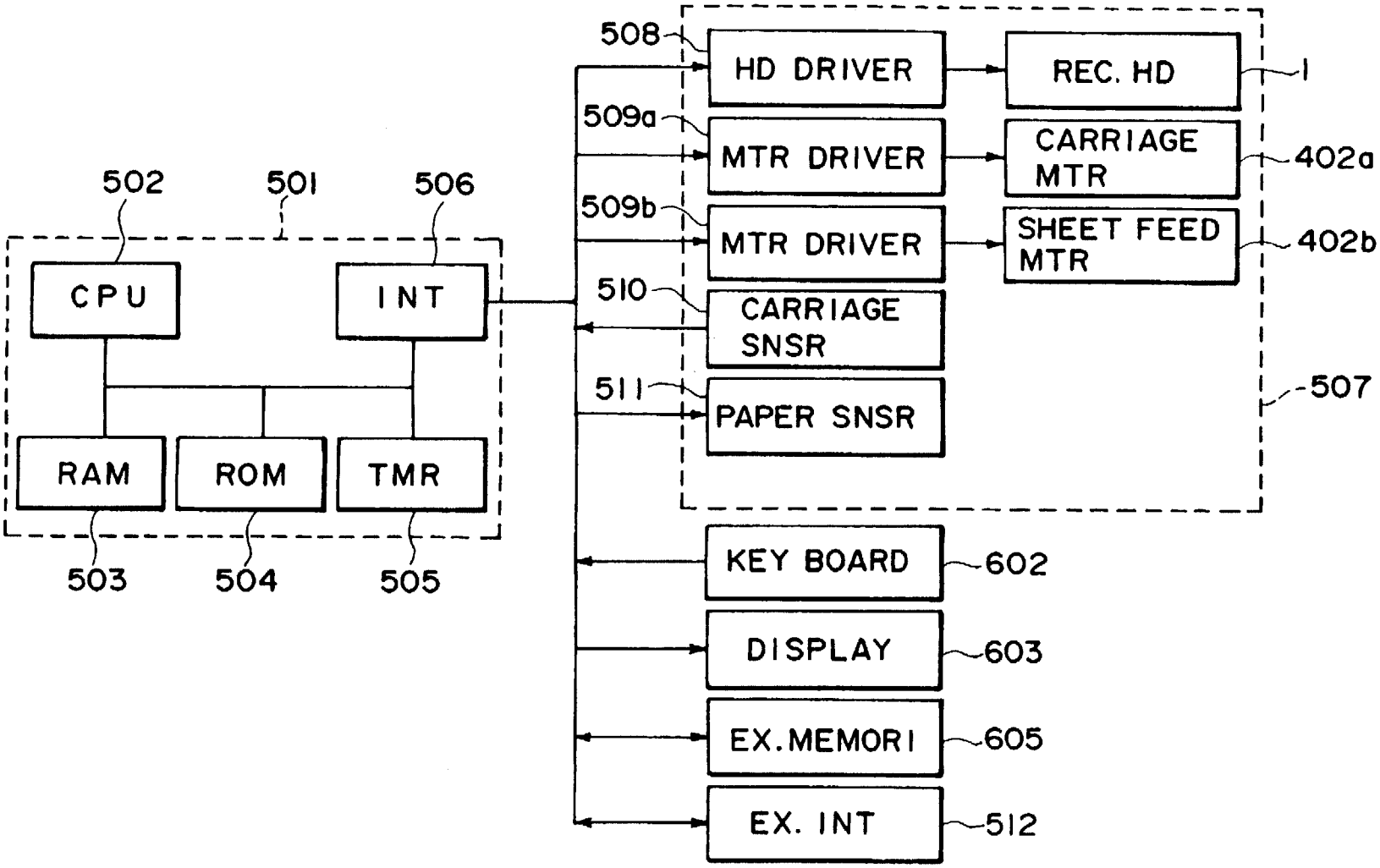
FIG. 6 is an electric circuit block diagram of information processing apparatus using the ink jet recording apparatus.

Referring to FIG. 5, there is shown such an information processing apparatus. In the Figure, reference numeral 601 designates the printer described in the foregoing; 602 a keyboard having keys for inputting letter, numerical and another characters and various command keys; 603 is a display; and 604 is the information processing apparatus. FIG. 6 is a block diagram of the electric circuit structure of the information processing apparatus. In this Figure, a reference numeral 501 is a controller for the main control operation; 502 is a CPU in the form of a microcomputer, for example, for carrying out various processes; 503 is a RAM including an area for converting text data or image data and a work area; 504 is a ROM for storing fixed data such as the program for the sequential operations and font data; 505 is a timer for producing executing cycle of the CPU 502 and producing necessary timing for the recording operation of the printer 12; 506 is an interface for supplying the signals from the CPU 502 to the peripheral device. Designated by a reference numeral 507 is a controller for the printer 601; 508 is a head driver for transmitting recording signal or electric power to the head cartridge 101; 509*a* and 509*b* are motor drivers for transmitting an electric signal or electric power for driving the carriage motor 402*a* and the feeding roller 402*b*; 510 is a carriage sensor for detecting a position of the carriage 102 to discriminate whether it is at the home position or not; 511 is a paper sensor for detecting presence or absence of the recording material 6 to prevent recording operation outside the recording material 6 when the recording material 6 is not set or when the printing operation is finished to the end of the page.

Furthermore, a reference numeral 605 designates an external memory such as FDD, HDD, RAM card or the like; 512 is an external interface for communication with another information processing apparatus or for connection directly with an internal bus to control the peripheral devices.

Although not shown in the block diagram of FIG. 6, there is a power source for supplying electric power to the above electric circuits. The power source may be in the form of a chargeable battery, a disposable dry battery or AC source converter fixedly used with the main assembly of the information processing apparatus.

Figure 7:
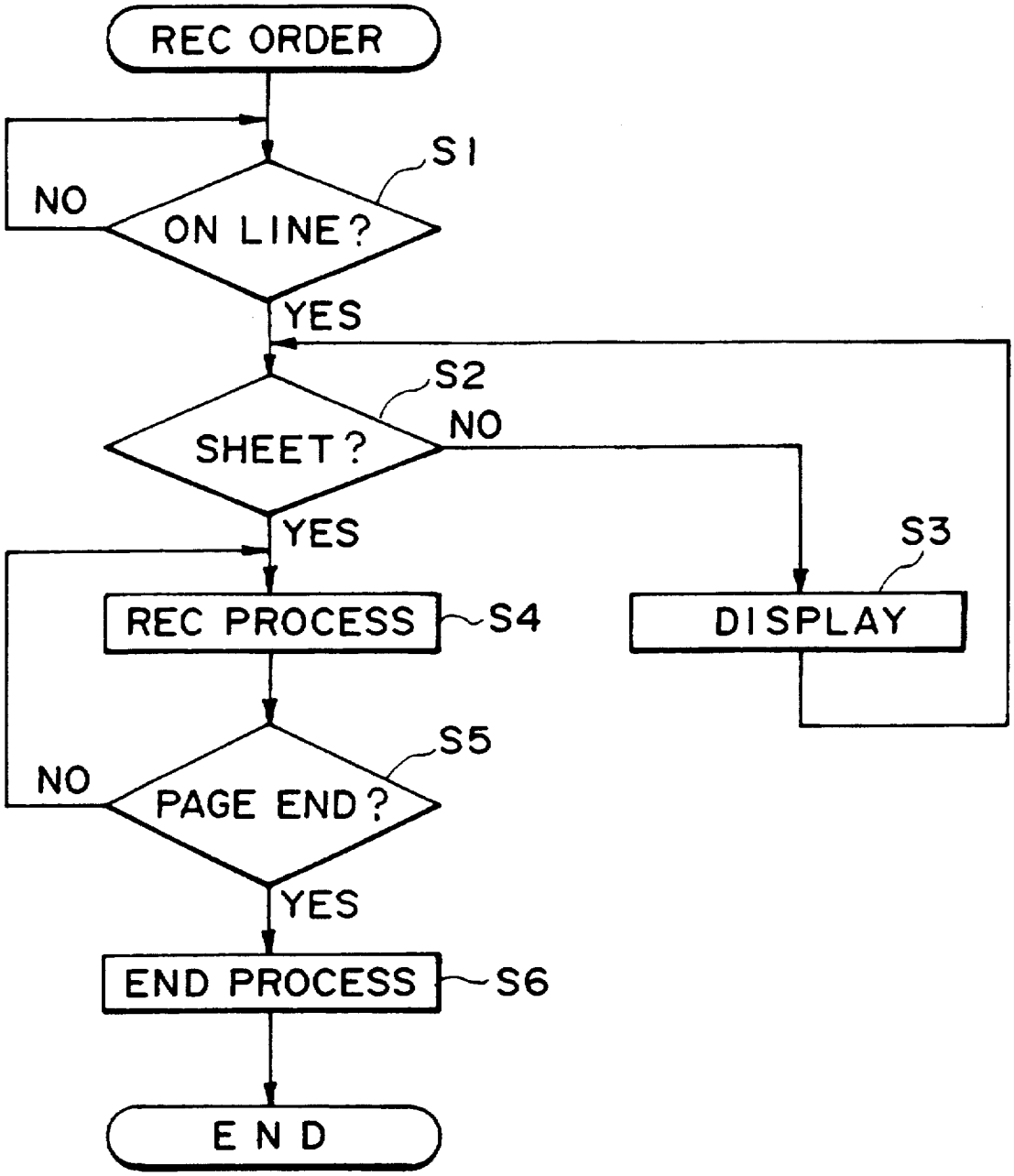
FIG. 7 is a flow chart representing the recording operation according to the first embodiment of the present invention.

Using the above-described electric circuit, the recording is effected on the recording material 6 at the recording position. Referring to FIG. 7, the sequential operation for the recording will be described. In response to a record starting signal responsive to the recording instruction key on an operation panel of the printer main assembly or in response to the record starting instruction from the external interface or the like, the following series of processing operations starts.

First, at step S1, the discrimination is made as to whether or not the on-line state is established, on the operation panel. This is done in order to assure that the recording operation is not started without sufficient preparation of the printer when the record starting signal is transmitted from the outside by communication or the like. If the on-line state is discriminated on the display panel, the operation proceeds to step S2.

At step S2, the discrimination will be made on the basis of the signal from paper sensor 511 as to whether or not the recording material 6 is set in the printer. Particularly in the case of ink jet printer, if the printing operation is started without the recording material, the ink scatters in the printer with the result of contamination of the apparatus, or the ink is consumed wastefully.

As step S2, the discrimination may be made as to whether or not the pinch roller 202 and the feeding roller 201 are released as well as the presence or absence of the recording material. If the pinch roller 202 is released even if the recording material 210 is set, the recording material is not properly fed. As to the discrimination whether the pinch roller 202 is released or not, the release lever may be provided with a mechanical switch. When the recording material is not properly set, step S3 is carried out.

At step S3, a message is produced to promote the operator to properly set the recording material. The message may be provided by lighting a lamp on the operation panel, or a sound may be produced.

If the recording material 6 is discriminated as having been properly set, at step S3, the operation proceeds to step S4.

At step S4, the recording operation is started. In response to the instruction from CPU 502, the head driver 508 drives the head cartridge 101. In synchronism therewith, the motor drivers 509*a* and 509*b* drive the carriage motor 402*a* and feeding motor 402*b* to effect the recording with movement of the carriage 102 in the main scan direction, the movement of the recording material in the sub-scan direction and the cleaning of the recording head 1.

At step S5, when the end of the recording operation is instructed in response to the signal from CPU 502. For example, or when the number of recording lines in the sub-scan direction on one page reaches the limit, or when the paper sensor 511 detects end of the recording region for the recording material 6, the end of the recording operation is discriminated to start the recording operation stopping process.

In the recording operation stopping process at step S6, the carriage 102 is first returned to the home position. This is done in order to cap the ink ejection side surface of the recording head 1 to protect it, for the preparation of the deactuation of the main switch after the stop of the recording operation. Then, the feeding motor 402*b* is driven through a predetermined amount, or the feeding motor 402*b* is driven until the paper sensor 510 detects the complete discharge of the recording material 6. The end of the recording operation is displayed on the panel by the CPU 502, or the event is notified to the peripheral apparatus through the external interface. Thus, the recording operation is finished.

As described in the foregoing, according to this embodiment, the recording head and the ink container are separable, and the ink passage can be combined therebetween selectively in two or more directions. Because of this feature, the following advantages are provided. The recording head mounting direction can be selected without being limited by the mounting direction of the ink container, and thus permitting selection of ink ejecting direction. Therefore, the position or using direction of the apparatus is selectable with higher latitude. In addition, a common head cartridge is usable for different types of machines.

In the ink cartridge of this embodiment, there is provided only one ink supply port of the ink container, and the connecting direction is changeable. Therefore, the structure is simplified.

Since the ink container is mounted on the carriage, the tube for the ink supply or the like can be omitted, thus accomplishing apparatus size reduction.

When the ink is used up, only the ink container, not including the ink jet head, may be exchanged. Therefore, the running cost can be reduced.

When one of recording head or ink container reaches the service life, only one requiring replacement may be exchanged, thus permitting economical operation. Upon the exchange of the recording head, the separation between the carriage and the recording head is made easier, and therefore, the exchanging operation is simplified.

Embodiment 2

Figure 8:
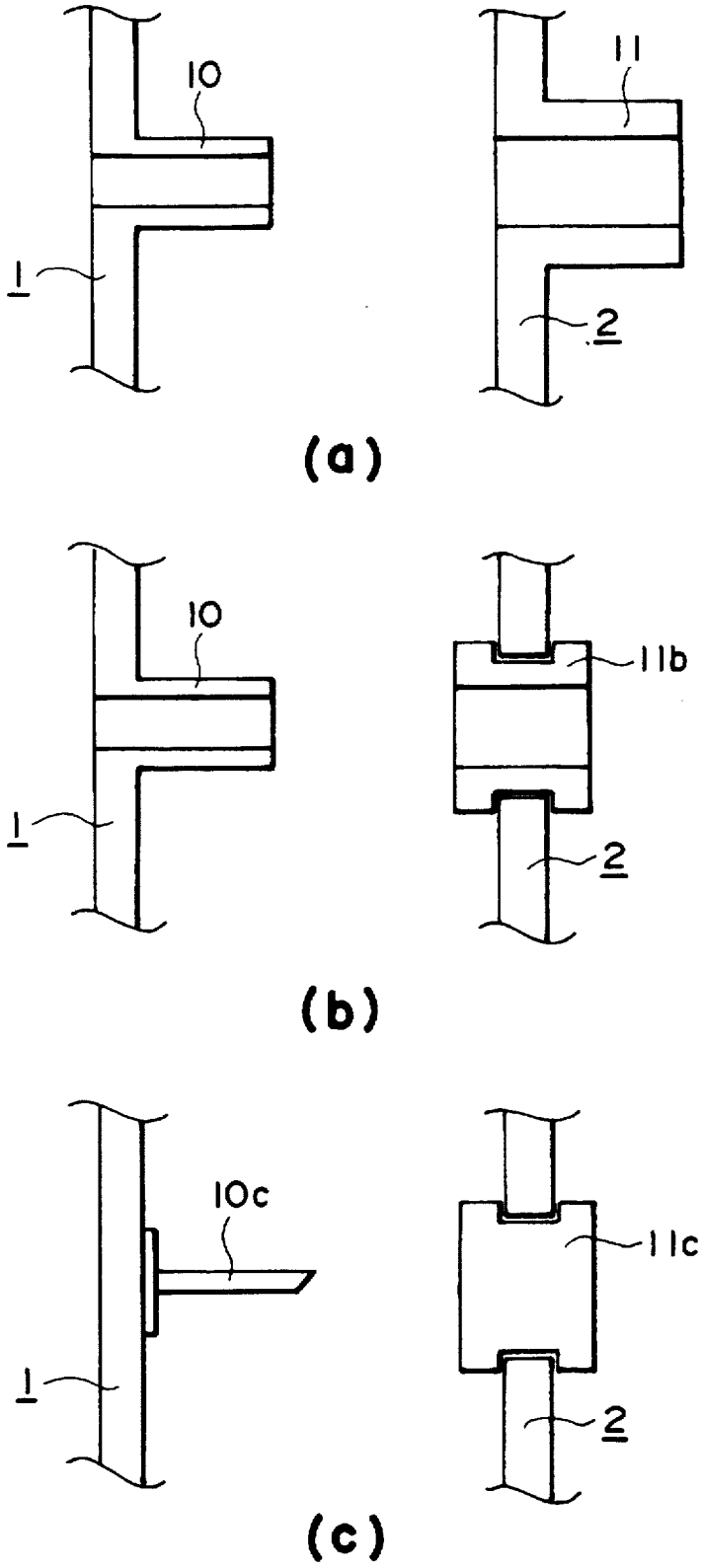
FIG. 8 is a schematic top plan view of the structure according to the second embodiment of the present invention.

Referring to FIG. 8, (b) and (c), there is shown an ink passage connecting portion between a recording head and an ink container according to another embodiment of the present invention. In FIG. 8, (b), the ink supply port 11*b* of the ink container is made of elastic material such as rubber. The inside diameter of the ink supply port 11*b* of the ink container is made smaller than the outer diameter of the ink inlet portion of the recording head, so that the close-contactness between the ink inlet portion 10 of the recording head and the ink supply port 11*b* of the ink container is improved upon connection between the recording head 1 and the ink container 2. The sealing performance of the ink passage is improved. The force required for deformation of the ink supply port 11 of the ink container may be smaller, and therefore, the force required for the mounting or demounting between the recording head and the ink container 2, can be reduced.

In FIG. 8, (c), the ink inlet portion 10*c* of the recording head is formed into a tube having a sharp end, and the ink supply portion 11*c* is constituted by elastic material such as rubber or the like. When it is separated from the recording head 1, the ink supply portion 11*c* of the ink container 2 is in the closed state so that the ink does not leak through the ink supply port 11*c*. Therefore, the ink container itself is easily manipulated. When the ink container 2 is connected to the recording head 1, the sharp end of the ink inlet portion 10*c* pierces the ink supply portion 11*c* to establish stabilized ink passage, and the force required for separating or connecting operation can be reduced.

Embodiment 3

In Embodiment 1, when the connecting relation between the ink jet head and the ink container is changed, the ink inlet portion and the ink supply port are not changed, but the mounting direction between the head and the ink container is changed by rotation. This structure is not limiting, and another structure is possible in which, for example, a plurality of ink inlet portion or ink supply ports are provided at different positions.

Figure 9:
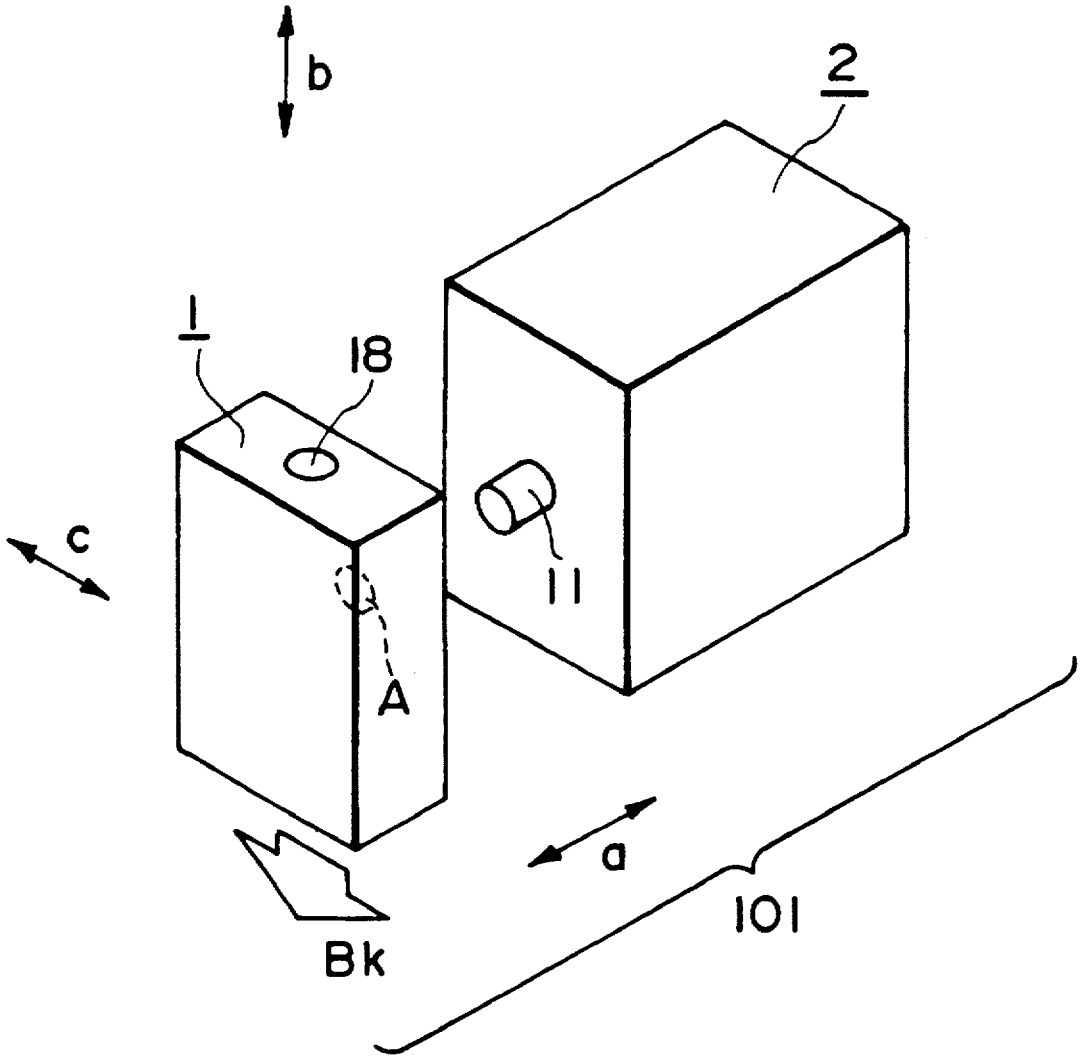
FIG. 9 is a schematic perspective view of a first structure according to a third embodiment of the present invention.

FIG. 9 is a schematic perspective view illustrating a connecting direction between a recording head and an ink container according to another embodiment of the present invention. In this Figure, reference numeral 1 designated an ink jet head; 18 is a first ink inlet portion of the recording head 1; A is a second ink inlet portion provided in a direction different from that of the first ink inlet portion 18; and 2 is an ink container. The head cartridge 101 is constituted by these parts.

The ink ejecting direction of the recording head is indicated by an arrow Bk in FIG. 9. The first ink inlet portion 18 and the second ink inlet portion A of the recording head are away from each other about 90 degrees. They are sealed when the ink supply port 11 of the ink container is not mounted thereto. By an unshown mechanism, it is opened only when the ink supply port 11 is mounted to establish the ink passage. When the ink container is mounted to either one of them, the other is closed, and therefore, the air is not introduced into the ink passage. When the ink containers are mounted to both of them, the smooth ink flow is assured.

In this case, the ink container 2, as contrasted to the first embodiment, the structure may be of a time not influenced by the gravity in the ink supply performance. If this is done, the ink container may be mounted in the direction a in FIG. 9 toward the second ink supply port 19, or it may be mounted in the direction b toward the first ink supply port 18.

When the head cartridge 101 is mounted to the carriage 102 of FIG. 4, the carriage moves in the direction a in FIG. 9 for its scanning operation. When the ink container 2 is mounted to the second ink supply part A without changing the direction of the recording head, the ink container is within the recording apparatus, and the total height can be reduced. When the ink container is mounted to the first ink supply port 18, the width of the carriage 102 can be reduced, and therefore, the entire width of the recording apparatus can be reduced. In addition, the total width of the recording apparatus can be reduced when another ink supply port (not shown) is mounted in the direction c and the ink container 2 is mounted there.

As described in the foregoing, by providing two more directions for the connection between the recording head and the ink container, the following advantageous effects can be provided.

The types of head cartridges can be changed with the same recording head, and is usable with various types of recording machines.

Embodiment 4

Figure 10:
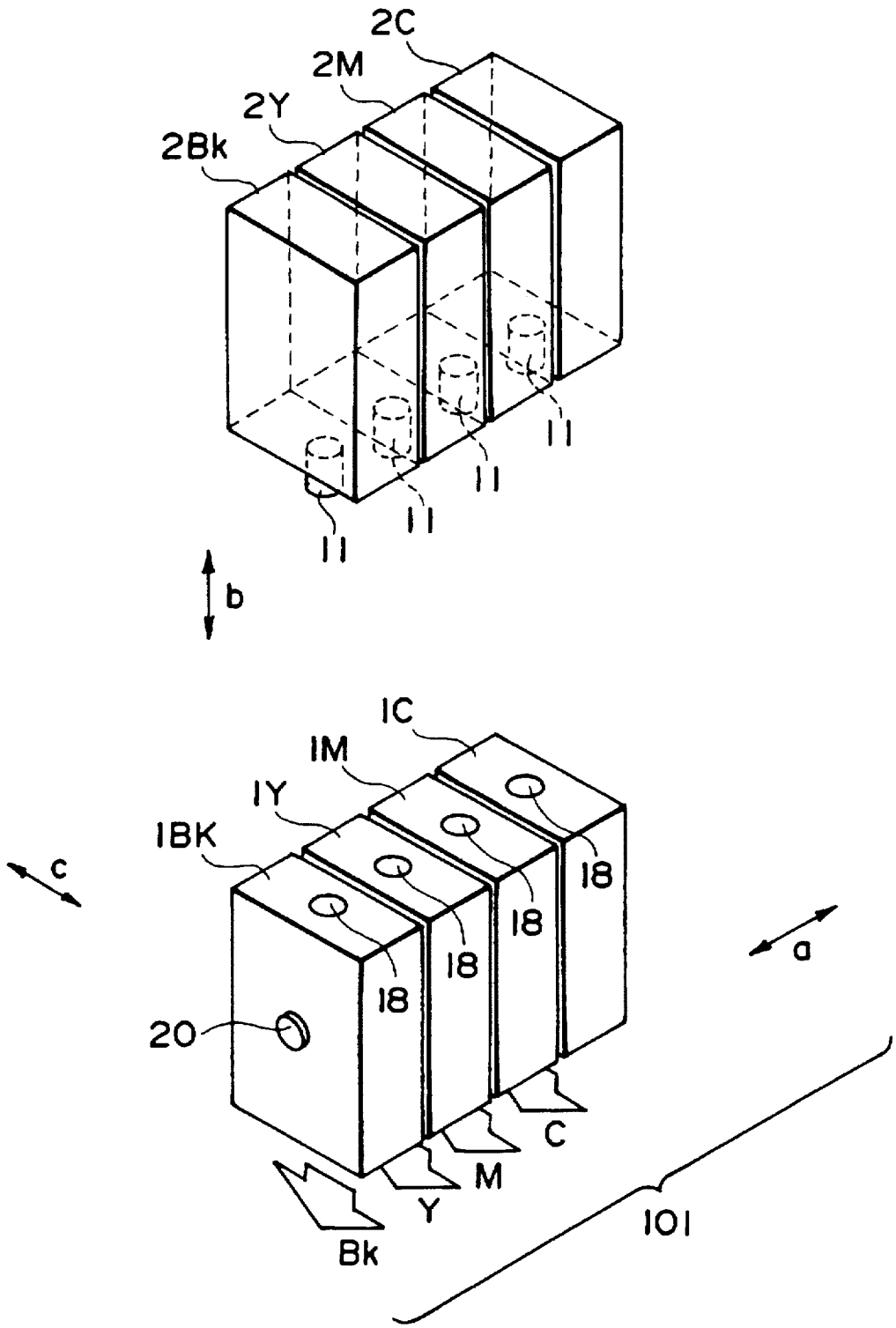
FIG. 10 is a schematic perspective view of a second structure according to a third embodiment of the present invention.
Figure 11:
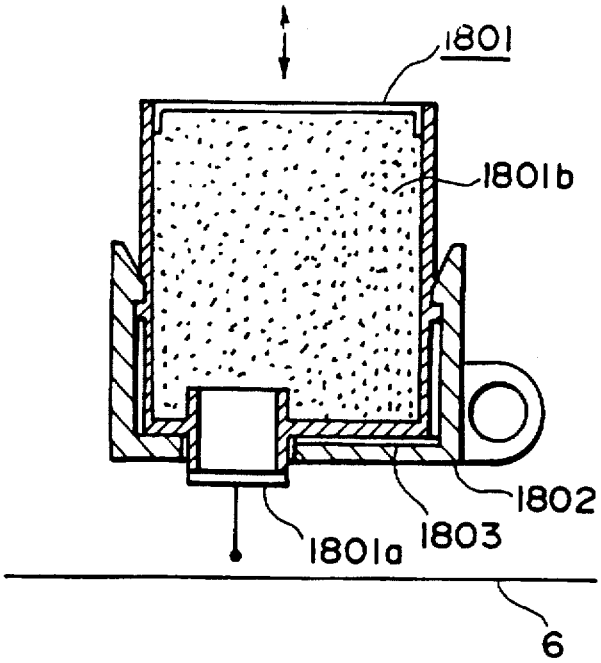
FIG. 11 PRIOR ART
FIG. 11 is a schematic sectional view of a conventional example.
Figure 12:
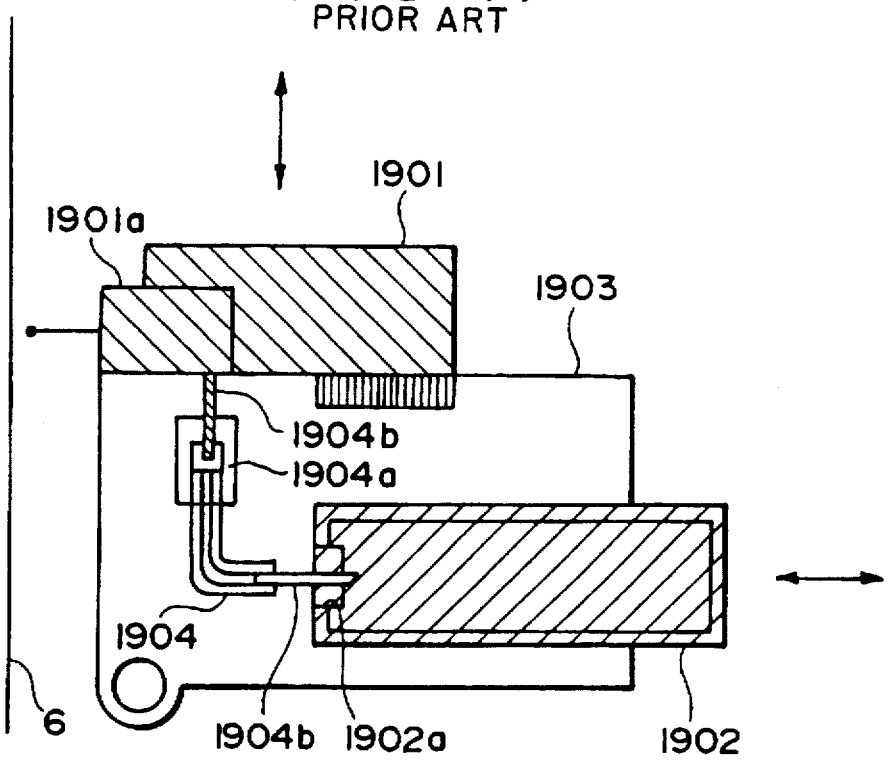
FIG. 12 PRIOR ART
FIG. 12 is a schematic sectional view of a conventional example.
Figure 13:
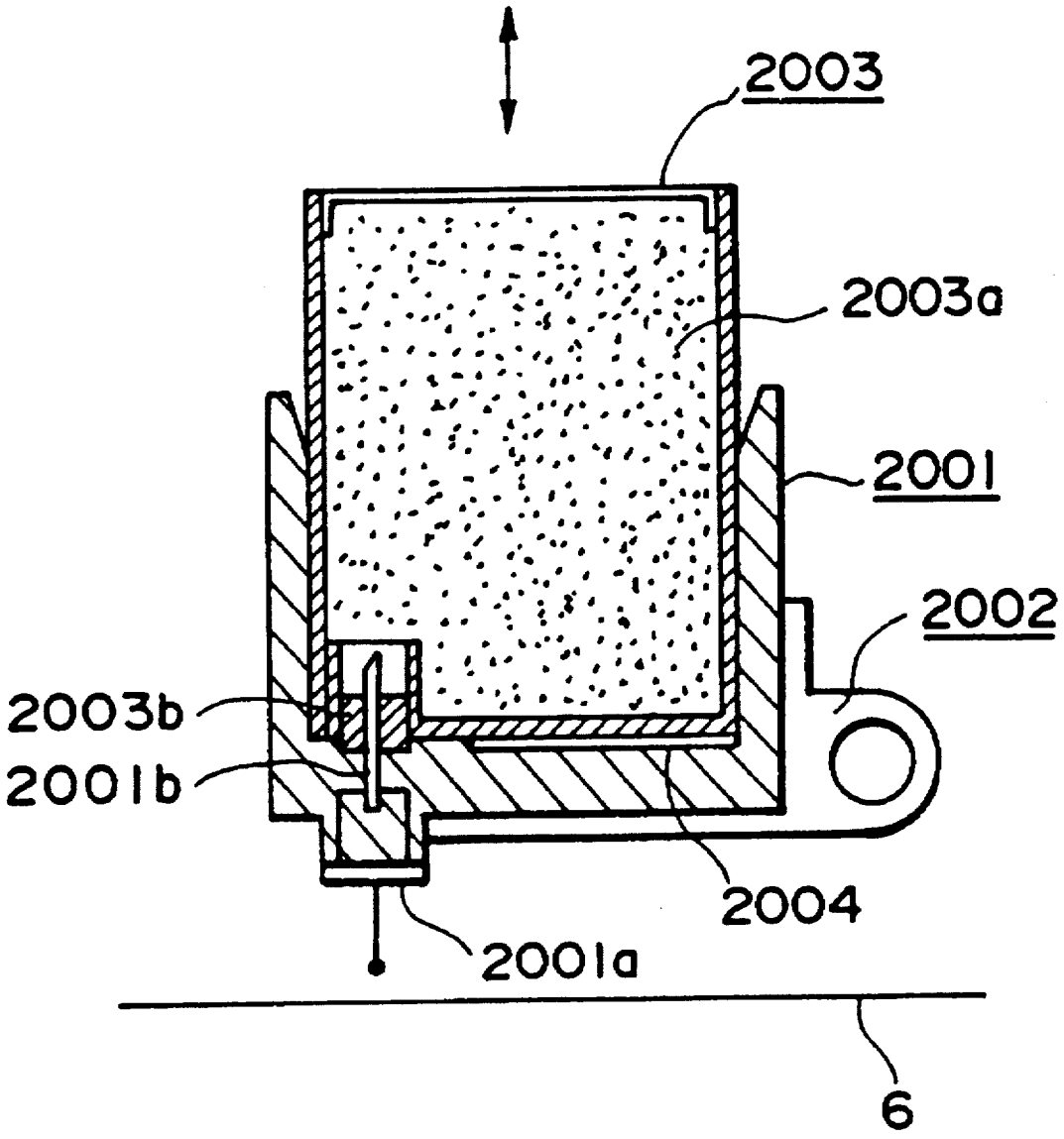
FIG. 13 PRIOR ART
FIG. 13 is a schematic sectional view of a conventional example.

FIG. 10 shows a further embodiment in which a color recording head is constituted using a plurality of (four) of the recording heads according to Embodiment 3.

In this Figure, Bk, Y, M and C annexed to the recording head 1 and the ink container 2, represent black, yellow, magenta and cyan ink recording heads and ink containers. Arrows Bk, Y, M and C in FIG. 10 are indicative of the ink ejecting directions. The configurations of the recording heads 1 may be the same as used in the third embodiment. The structure of the first ink inlet portion 18 is usable for connection with the ink container. In the case of the color recording head, it is required that the positioning accuracy among the recording heads are high. In view of this, a positioning projection 20 may be provided on the side of the recording head 1 on a surface opposite from the second ink inlet portion, by which it is engageable with the second ink inlet portion of the recording head to position it.

An ink supply port for the recording head may be extended in the direction c in FIG. 10 for connection with the ink container.

As described in the foregoing, there are provided two or more mounting directions between the recording head and the ink container to permit use of a plurality of recording heads and ink containers, by which the following advantageous effects are provided.

By adding plural color head cartridges to the head cartridge used for monochromatic color, by which the color recording cartridge is easily provided.

If the size of the monochromatic ink container and the size of the recording head to be added for the multi-color recording, are substantially the same, the monochromatic recording operation and multi-color recording operation are possible with the common carriage, and therefore, a small size low cost color recording apparatus can be provided.

By using the ink supply port of the recording head for the positioning, the positioning among the recording heads can be assured, thus permitting high quality color recording.

The present invention is particularly suitably usable with any ink jet apparatus, such as those using electromechanical converter such as piezoelectric element, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents.

The present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, in an ink container and recording head can be connected two or more different directions. This provides the following advantages.

The recording head mounting direction can be selected without limitation by the ink container mounting direction, and therefore, the ink ejecting direction can be more freely selected. The installation direction or the like of the apparatus can be determined with higher latitude.

Since the ink container is mounted on the carriage, the tube or the like for the ink supply can be omitted.

When the ink is used up, only the ink container is exchanged, and therefore, the running cost can be reduced.

When only one of the recording head and the ink container is required to be replaced, only the one can be replaced, and therefore, the economical operation is possible.

When the recording head is to be replaced, it is easily removed from the carriage, and therefore, the replacing operation is made easier.

The types of the head cartridge can be changed with one type of recording head, and it becomes usable for wider range of recording apparatuses.

By adding plural color head cartridges to the head cartridge used for the monochromatic recording, by which the color recording cartridge can be easily provided.

If the size of the ink container for the monochromatic recording and the size of the recording head to be added for the multi-color recording, are made the same, the monochromatic recording and multi-color recording can be carried out with a common carriage, and therefore, small size low price color recording apparatus can be provided.

By using the ink supply port of the recording head for the positioning, the positioning among the recording heads can be assured, thus accomplishing high quality color recording.

While the invention has been described with reference to the structures disclosed herein, it is not confined to the details set forth and this application is intended to cover such modifications or changes as may come within the purposes of the improvements or the scope of the following claims.

What is claimed is:

1. An ink container detachably connectable with an ink inlet of an ink jet head for ejecting ink, the ink jet head having connecting means for connecting to said container, comprising:

an outer housing;

an ink supply having an ink supply port for supplying the ink to the ink inlet of the ink jet head; and two pairs of connecting portions, connecting portions for each pair being shaped complementarily to that of said connecting means of said ink let head and being disposed at opposite sides of said housing, for connection with the connecting means of the ink jet head, wherein said two pairs of connecting portions are directed in directions crossing with each other to permit connection with the ink jet head in a plurality of different directions, whereby the direction of said ink container relative to the ink let head can be selected in a direction that permits stabilized supply of ink irrespective of orientation of the ink jet head.

2. An ink jet head cartridge for ejecting ink, comprising:

an ink jet head including an ejection outlet for ejecting the ink, an ink passage in communication with the ink ejection outlet, an ink ejection pressure generating element provided corresponding to the ink liquid passage, an ink inlet for receiving ink, and connecting means for connecting to a pair of connection portions; and an ink container detachably connected with said ink inlet, said ink container including an outer housing, an ink supply having an ink supply port for supplying the ink to said ink inlet, and two pairs of connecting portions, with connecting portions for each pair being shaped complementarily to that of said connecting means and being disposed at opposite sides of said housing, for connection with said connecting means;

wherein said two pairs of connecting portions are directed in directions crossing with each other to permit connection with said ink jet head in a plurality of different directions, whereby the direction of said ink container relative to said ink jet head can be selected in a direction that permits stabilized supply of ink irrespective of orientation of said ink let head.

3. An ink jet apparatus for ejecting ink to effect recording, comprising:

an ink jet cartridge comprised by an ink jet head detachably connected to an ink container; and a carriage for detachably mounting said ink jet cartridge;

wherein said ink jet head includes an election outlet for ejecting the ink, an ink passage in communication with the ink election outlet, an ink election pressure generating element provided corresponding to the ink liquid passage, an ink inlet for receiving ink, and connecting means for connecting to a pair of connection portions; and wherein said ink container includes an ink container detachably connected with said ink inlet, said ink container including an outer housing, an ink supply having an ink supply port for supplying the ink to said ink inlet, and two pairs of connecting portions, with connecting portions for each pair being shared complementarily to that of said connecting means and being disposed at opposite sides of said housing, for connection with said connecting means; and wherein said two pairs of connecting portions are directed in directions crossing with each other to permit connection with said ink jet head in a plurality of different directions, whereby the direction of said ink container relative to said ink let head can be selected in a direction that permits stabilized supply of ink irrespective of orientation of said ink let head.

* * * * *

UNITED STATES PATENT AND TRADEMARK OFFICE

CERTIFICATE OF CORRECTION

PATENT NO. : 5,896,152

DATED : April 20, 1999

INVENTOR : Tetsuyo Ohashi

It is certified that error appears in the above-identified patent and that said Letters Patent is hereby corrected as shown below:

COLUMN 1

Line 59, "upon" should read --when--.

COLUMN 2

Line 51, "Jet" should read --jet--.

COLUMN 3

Line 29, "ate" should read --are--.

COLUMN 4

Line 18, "to" should read --to achieve--; and
Line 31, "correction" should read --connection--.

COLUMN 7

Line 8, "another" should read --other--.

COLUMN 10

Line 11, "part A" should read --port A--.

COLUMN 12

Line 57, "let" should read --jet--; and
Line 65, "let" should read --jet--.

UNITED STATES PATENT AND TRADEMARK OFFICE

CERTIFICATE OF CORRECTION

PATENT NO. : 5,896,152

DATED : April 20, 1999

INVENTOR : Tetsuyo Ohashi

It is certified that error appears in the above-identified patent and that said Letters Patent is hereby corrected as shown below:

COLUMN 13

Line 23, "let" should read --jet--.

COLUMN 14

Line 2, "election" should read --ejection--;
Line 4, "election (both occurrences) should read --ejection--;
Line 15, "shared" should read --shaped--;
Line 23, "let" should read --jet--; and
Line 25, "let" should read --jet--.

Signed and Sealed this

Twenty-eighth Day of March, 2000

*Attest:*

Q. TODD DICKINSON

*Attesting Officer*

*Commissioner of Patents and Trademarks*